US012760931B2

(12) United States Patent
Beyhaghi et al.

(10) Patent No.: US 12,760,931 B2
(45) Date of Patent: Oct. 13, 2026

(54) SYSTEMS AND METHODS FOR VACUUM INSULATION PANELS FOR WATER HEATER TANKS

(71) Applicant: Rheem Manufacturing Company, Atlanta, GA (US)

(72) Inventors: Saman Beyhaghi, Opelika, AL (US); Nathan Andrew, Opelika, AL (US); Atilhan Manay, Roswell, GA (US)

(73) Assignee: Rheem Manufacturing Company, Atlanta, GA (US)

( * ) Notice: Subject to any disclaimer, the term of this patent is extended or adjusted under 35 U.S.C. 154(b) by 379 days.

(21) Appl. No.: 18/419,969

(22) Filed: Jan. 23, 2024

(65) Prior Publication Data

US 2024/0263835 A1 Aug. 8, 2024

Related U.S. Application Data

(60) Provisional application No. 63/483,799, filed on Feb. 8, 2023.

(51) Int. Cl.
*F24H 1/18* (2022.01)

(52) U.S. Cl.
CPC ..... *F24H 1/182* (2013.01)

(58) Field of Classification Search
CPC ..... F24H 9/133; F24H 1/182; F24H 1/183; F24H 9/02; B29C 44/1247; B29L 2031/7156
See application file for complete search history.

(56) References Cited

U.S. PATENT DOCUMENTS

| | | | | |
|---|---|---|---|---|
| 5,208,964 | A * | 5/1993 | Nelson | B29C 44/1247 29/460 |
| 7,226,552 | B2 * | 6/2007 | Manini | F24H 1/182 264/46.4 |
| 10,401,876 | B1 * | 9/2019 | Coleman | G05D 7/00 |
| 10,968,625 | B2 * | 4/2021 | Mack | E04B 1/803 |
| 11,231,237 | B2 * | 1/2022 | Chopard | F28F 3/12 |
| 2019/0111894 | A1 * | 4/2019 | Sato | B60S 1/24 |

FOREIGN PATENT DOCUMENTS

| | | | | |
|---|---|---|---|---|
| CN | 203561063 | U * | 4/2014 | |
| CN | 109269100 | A * | 1/2019 | F24H 9/2007 |
| DE | 202011050315 | U1 * | 9/2012 | F24H 1/182 |
| DE | 202011103204 | U1 * | 11/2012 | F24H 1/182 |
| DE | 102017114810 | A1 * | 1/2018 | F24H 1/182 |
| DE | 102018002065 | A1 * | 9/2019 | F16L 59/028 |
| EP | 3705805 | A1 * | 9/2020 | F28D 20/0034 |
| ES | 2681657 | T3 * | 9/2018 | F28D 20/0034 |
| KR | 20020070941 | A * | 9/2002 | F24H 9/133 |

* cited by examiner

*Primary Examiner* — Gregory A Wilson
(74) *Attorney, Agent, or Firm* — Eversheds Sutherland (US) LLP

(57) ABSTRACT

A vacuum insulation panel is disclosed for use with a storage vessel having a storage vessel outer surface. The vacuum insulation panel includes: a vacuum insulation panel inner surface configured to cover a portion of the storage vessel outer surface; a vacuum insulation panel outer surface separated from the vacuum insulation panel inner surface by a vacuum space; and a spacer disposed within the vacuum space, being in contact with the vacuum insulation panel inner surface and the vacuum insulation panel outer surface and maintaining a separation of the vacuum insulation panel inner surface and the vacuum insulation panel outer surface.

18 Claims, 7 Drawing Sheets

SYSTEMS AND METHODS FOR VACUUM INSULATION PANELS FOR WATER HEATER TANKS

CROSS-REFERENCE TO RELATED APPLICATIONS

This application claims priority to and the benefit of U.S. provisional application No. 63/483,799, filed Feb. 8, 2023, which is hereby incorporated by reference herein in its entirety.

FIELD

This disclosure relates generally to water heaters and more particularly relates to vacuum insulated panels for water heater tanks.

BACKGROUND

FIG. 1 illustrates a water heater 100. The water heater 100 includes a main body 102, a cold water input line 104, and a hot water output line 106. In operation, cold water is fed into the main body 102 via the cold water input line 104. The main body 102 includes at least one heating source that heats the cold water to a user-controlled temperature. The heating source may be any known type of water heating source, non-limiting examples of which include a resistive heating element, a gas-fired heat source, or a heat pump. When needed, the heated water is output through the hot water output line 106. When hot water is not needed, the hot water stored in the main body 102 rests, wherein the hot water cools over time as heat is conducted outside of the main body 102.

FIG. 2 illustrates a cross-sectional view of a portion 108 of the water heater 100 of FIG. 1. The portion 108 of the water heater 100 includes a volume of heated water 202, a wall of a water tank 204, a layer of insulation 206, and a metal jacket 208. The water tank may form a storage vessel. The wall of the water tank 204 is typically made of metal (or other metals or alloys), whereas the layer of insulation 206 is typically made of a less heat conductive material, such as fiberglass or a heat resistant foam or the like. It should be noted that that the relative thickness of the wall of a water tank 204, the layer of insulation 206, and the metal jacket 208 in the FIG. 2 are for illustrative purposes only and may not be representative of the dimensions of an actual water heater.

FIG. 2 illustrates the heat transfer of the many layers of the water heater 100. In particular, the volume of heated water 202 conducts heat through convection to the wall of the water tank 204, as shown by arrow 210. The wall of the water tank 204 then conducts heat from the heated water 202 to the layer of insulation 206, as shown by arrow 212. Typically, the layer of insulation 206 is formed of fiberglass or a foam. Heat eventually conducts through the layer of insulation 206 from the wall of the water tank 204 to the metal jacket 208, as shown by arrow 214. Heat conducts from the layer of insulation 206 through the metal jacket 208, as shown by arrow 216, to reach the outer air surrounding the water heater 100. In particular, the heat from the metal jacket 208 escapes to the air surrounding the water heater 100 via convection, as shown by arrow 218.

The heat transfer from the water within the water heater 100 includes the heat transfer by convection as shown by arrow 210, the heat transfer by conduction as shown by arrow 212, the heat transfer by conduction as shown by arrow 214, the heat transfer by conduction as shown by arrow 216, and the heat transfer by convection as shown by arrow 218. The rate of heat transfer through each of the heated water 202, the wall of the water tank 204, the layer of insulation 206 and the metal jacket 208 is the same (under a steady state condition), and equals overall heat transfer rate. The overall thermal resistance is equal to the sum of the thermal resistances of the heated water 202, the wall of the water tank 204, the layer of insulation 206 and the metal jacket 208.

Heat will dissipate from water heater 100 as discussed above. The issue to be addressed is the rate at which heat dissipates from the water heater 100. In particular, typically, the water heater 100 is programmed to maintain a minimum temperature for the water stored therein. When heat escapes the water heater 100 as discussed above through convection and conduction, eventually the temperature of the water stored therein drops below the programmed minimum temperature. In such an event, at least one heating source within the water heater 100 will be activated to heat the water above the programmed minimum temperature.

Heating the water to maintain the programmed minimum temperature takes energy, which costs money. The quicker the rate at which heat dissipates from the water heater 100, the more often the water therein needs to be reheated, which again costs money. This decreases the efficiency of the water heater 100.

BRIEF DESCRIPTION OF THE DRAWINGS

The detailed description is set forth with reference to the accompanying drawings. In some instances, the use of the same reference numerals may indicate similar or identical items. Various embodiments may utilize elements and/or components other than those illustrated in the drawings, and some elements and/or components may not be present in various embodiments. Throughout this disclosure, depending on the context, singular and plural terminology may be used interchangeably.

DETAILED DESCRIPTION

This disclosure relates generally to insulating systems and methods for water heater tanks. In certain embodiments, a vacuum insulation panel (VIP) is used to surround a water tank in a water heater. The VIP reduces the amount of heat transfer through conduction and mostly limits heat transfer through radiation. Heat transfer through radiation has a much lower rate of heat transfer as compared to that of heat transfer through conduction. As a result, the VIP reduces the rate of heat dissipation from the hot water resting in the water heater to the surrounding environment. The reduction in the rate of heat dissipation from the hot water resting in the water heater improves the overall efficiency of the hot water heater.

Figure 3:
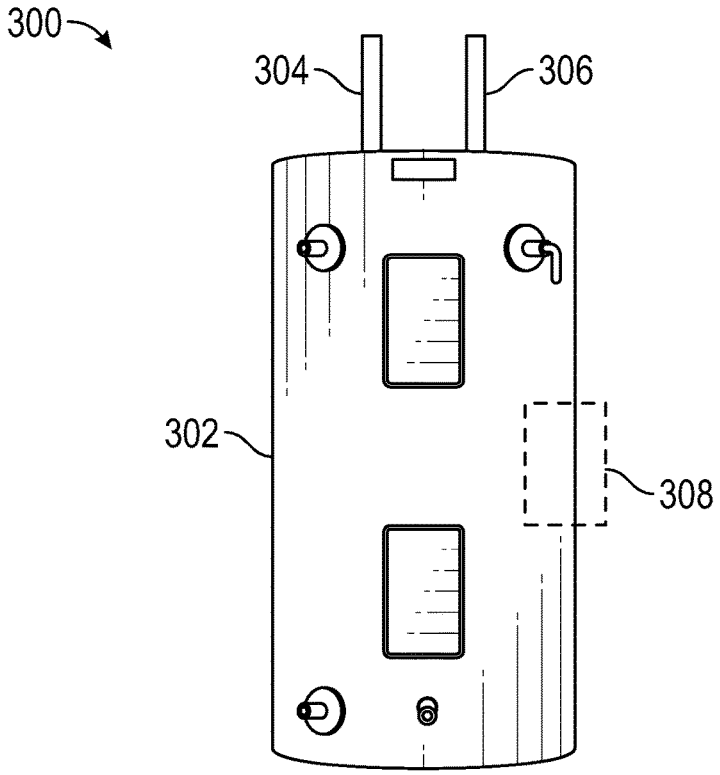
FIG. 3 illustrates a water heater in accordance with one or more embodiments of the present disclosure.

Turning now to the drawings, FIG. 3 illustrates a water heater 300 in accordance with one or more embodiments of the present disclosure. The water heater 300 includes a main body 302, a cold water input line 304, and a hot water output line 306. The water heater 300 may form a storage vessel having an outer wall. In operation, cold water is fed into the main body 302 via the cold water input line 304. The main body 302 includes at least one heating source that heats the cold water to a user-controlled temperature. When needed, the heated water is output through the hot water output line 306. When hot water is not needed, the hot water stored in the main body 302 rests therein, wherein the hot water cools over time as heat is conducted outside of the main body 302.

Figure 1:
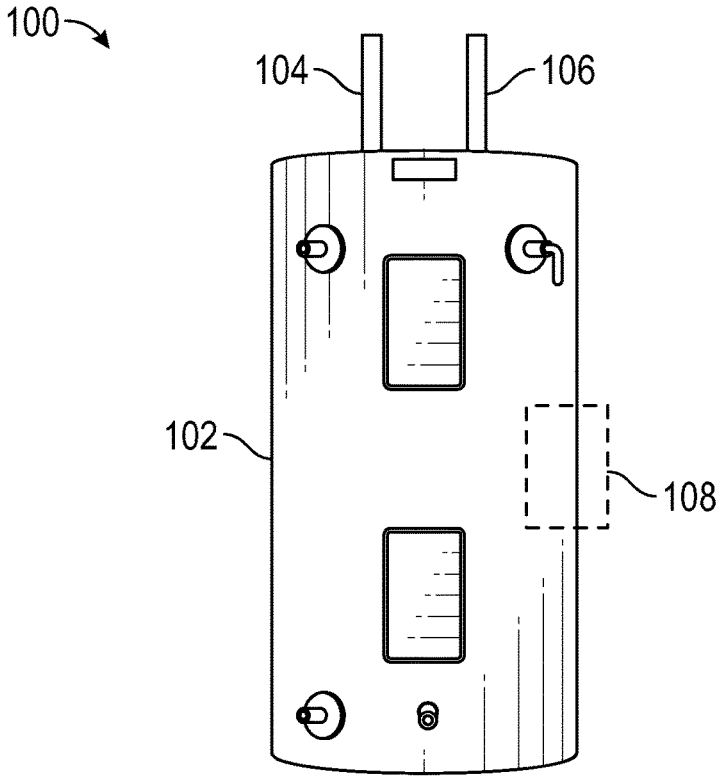
FIG. 1 (Prior Art)
FIG. 1 illustrates a prior art water heater.
Figure 2:
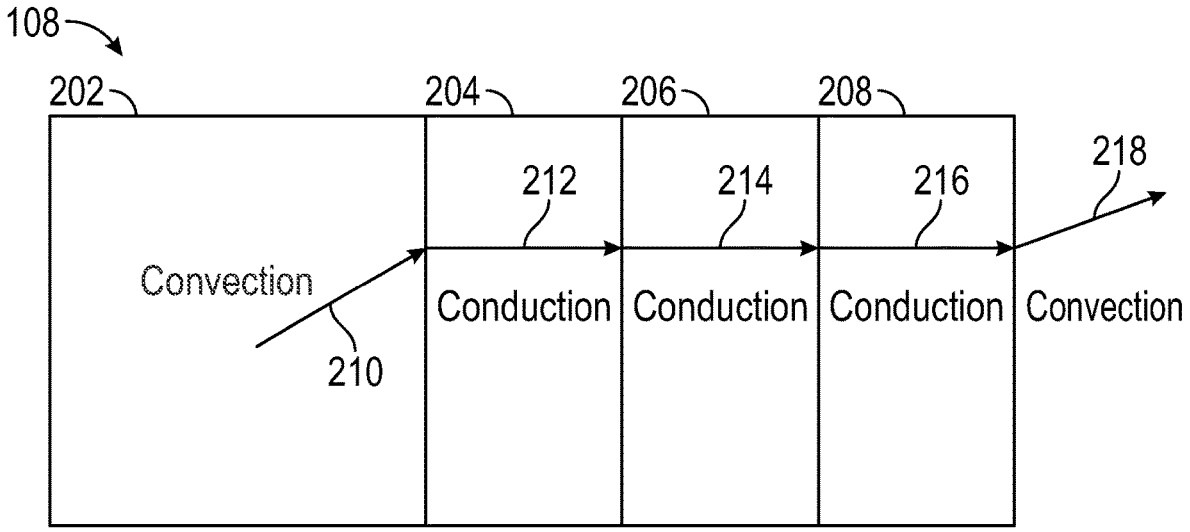
FIG. 2 (Prior Art)
FIG. 2 illustrates a cross-sectional view of a portion of the water heater of FIG. 1.
Figure 4:
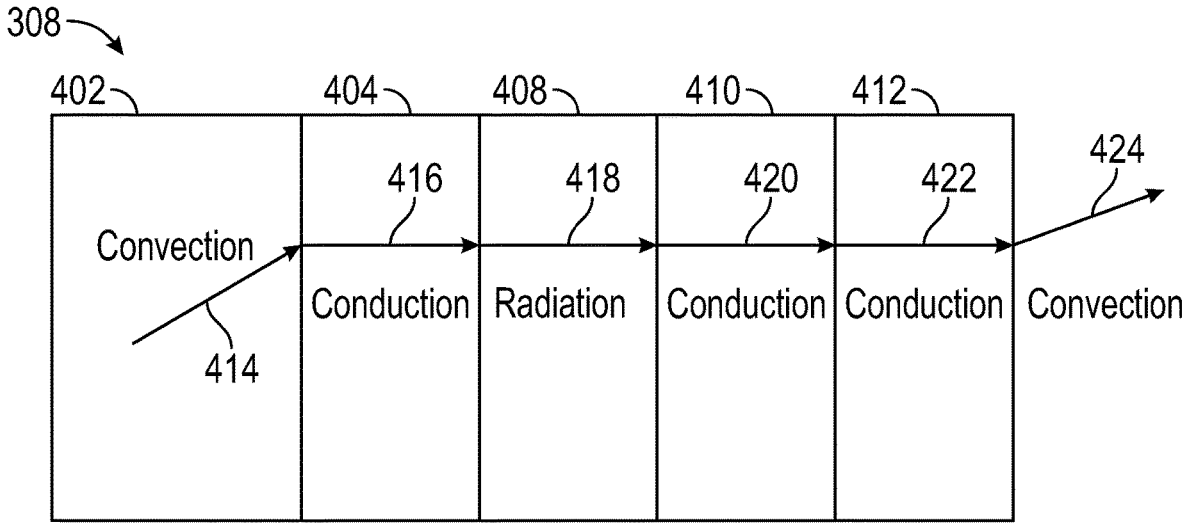
FIG. 4 illustrates a cross-sectional view of a portion of the art water heater of FIG. 3 in accordance with one or more embodiments of the present disclosure.

FIG. 4 illustrates a cross-sectional view of a portion 308 of the water heater 300 of FIG. 3. As depicted in FIG. 4, the portion 308 of the water heater 300 includes a volume of heated water 402, a wall of the water tank 404, a VIP 408, a layer of insulation 410, and a metal jacket 412. The wall of the water tank 404 is similar to the wall of the water tank 204 discussed with reference to FIG. 2. The layer of insulation 410 is similar to the layer of insulation 206 discussed with reference to FIG. 2. However, the layer of insulation 410 may be thinner than the layer of insulation 206, or in some cases totally omitted, as a result of the VIP 408. The metal jacket 412 is similar to the metal jacket 208 discussed with reference to FIG. 2.

The VIP 408 includes a VIP inner surface that is configured to cover at least a portion of the wall of the water tank 404 and a VIP outer surface separated from the VIP inner surface by a vacuum space. In some instances, the outer wall of the water tank 404 and the VIP inner surface may be one and the same. That is, the outer wall of the water tank 404 may form the VIP inner surface of the VIP 408. In this manner, a vacuum may be formed between the outer wall of the water tanks and the VIP outer surface. The vacuum may be a true or partial vacuum. For example, during manufacture, the air in the vacuum space may be pumped out to minimize pressure within the vacuum space, thus leaving a minimum number of particles. This minimum number of particles within the vacuum space decreases the rate of thermal conduction and thermal convection. As a result, the major type of thermal transfer across the VIP 408 is limited to radiation. Accordingly, the VIP 408 reduces the rate of heat transfer as the thermal conduction and thermal convection are reduced.

FIG. 4 illustrates the heat transfer of the many layers of the water heater 300. In particular, the volume of heated water 402 transfers heat through convection to the wall of the water tank 404, as shown by arrow 414. The wall of the water tank 404 then conducts heat from the heated water 402 to the VIP 408.

In certain embodiments, the vacuum space in the VIP 408 may not be a true vacuum. However, the amount of air particles therein may be reduced. This reduces the amount of heat transfer through the VIP 408 via conduction and convection. The VIP 408 therefore radiates heat to the layer of insulation 420, as shown by arrow 418. Heat eventually conducts through the layer of insulation 420 from the VIP 408 to the metal jacket 412, as shown by arrow 420.

Heat conducts from the layer of insulation 420 through the metal jacket 412, as shown by arrow 422, to reach the outer air surrounding the water heater 300. In particular, the heat from the metal jacket 412 escapes to the air surrounding the water heater 300 via convection as shown by arrow 424.

The heat transfer from the water within the water heater 300 includes the heat transfer by convection as shown by arrow 414, the heat transfer by conduction as shown by arrow 416, the heat transfer by radiation as shown by arrow 418, the heat transfer by conduction as shown by arrow 420, the heat transfer by conduction as shown by arrow 422, and the heat transfer by convection as shown by arrow 424. The rate of heat transfer through each of the heated water 402, the wall of the water tank 404, the vacuum space in the VIP 408, the layer of insulation 410, and the metal jacket 412 is the same (under a steady state condition), and equals overall heat transfer rate. The overall thermal resistance is equal to the sum of the thermal resistances of the heated water 402, the wall of the water tank 404, the vacuum space in the VIP 408, the layer of insulation 410, and the metal jacket 412.

Heat will dissipate from the water heater 300. However, in contrast with the rate at which heat dissipates from the water heater 100, as discussed with reference to FIG. 2, as a result of the inclusion of the VIP 408 that has a much lower rate heat transfer through radiation, the overall rate at which heat dissipates from the water heater 300 is much lower.

The water heater 300 may be programmed to maintain a minimum temperature for the water stored therein. When heat escapes the water heater 300 through convection, radiation, and conduction, eventually the temperature of the water stored therein may drop below the programmed minimum temperature. In such an event, at least one heating source within the water heater 300 may be activated to heat the water above the programmed minimum temperature. Heating the water to maintain the programmed minimum temperature takes energy, which costs money. Because the rate at which heat dissipates from the water heater 300 is much lower than the rate at which heat dissipates from the water heater 100, the efficiency of the water heater 300 higher than the efficiency of the water heater 100.

Figure 5:
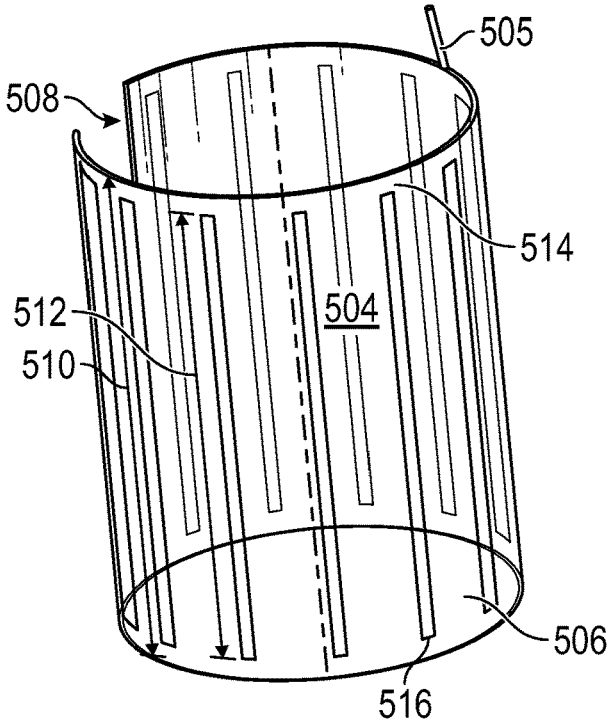
FIG. 5 illustrates a vacuum insulation panel (VIP) in accordance with one or more embodiments of the present disclosure.
Figure 6:
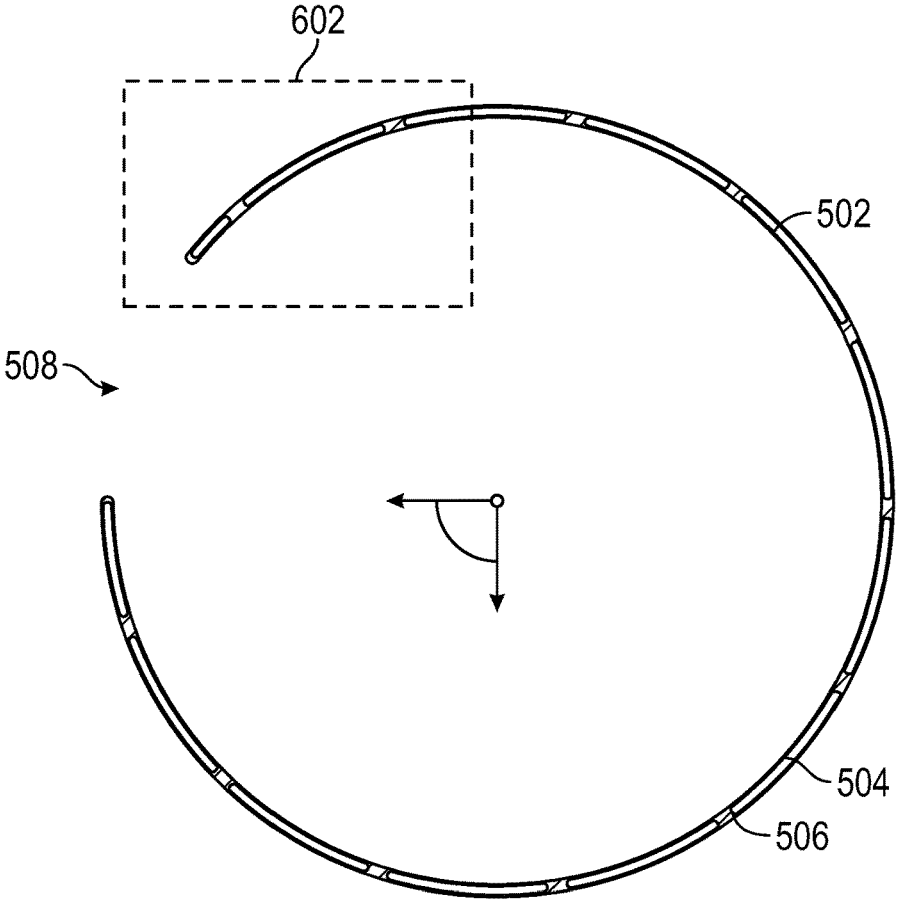
FIG. 6 illustrates a horizontal cross-sectional view of the VIP of FIG. 5 in accordance with one or more embodiments of the present disclosure.
Figure 7:
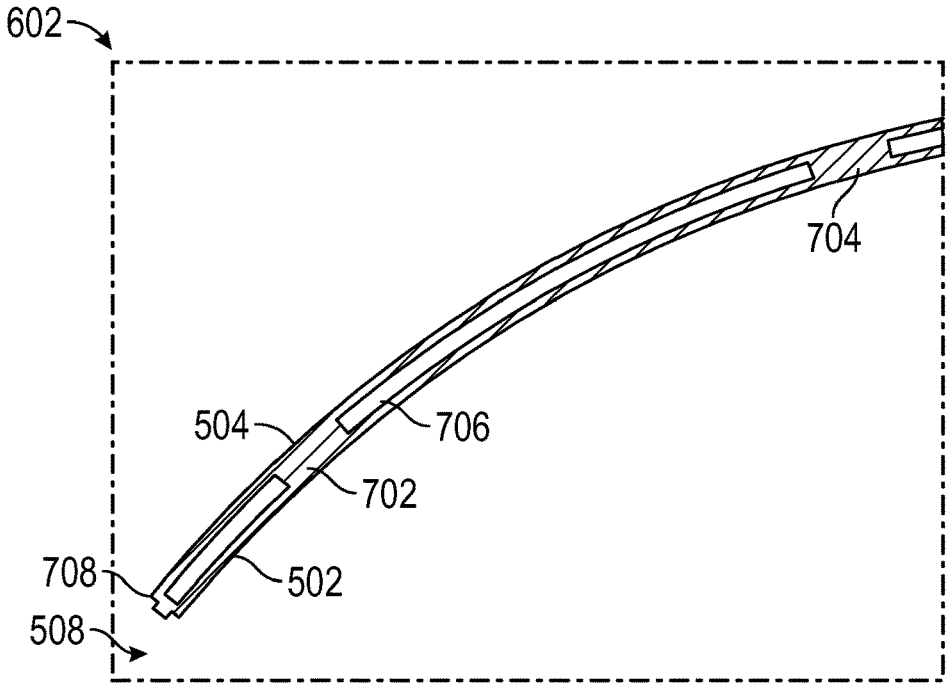
FIG. 7 illustrates an enlarged view of a portion of the horizontal cross-sectional view of FIG. 6 in accordance with one or more embodiments of the present disclosure.

FIG. 5 illustrates the VIP 408 in accordance with one or more embodiments of the present disclosure. The VIP 408 includes a VIP inner surface 502, a VIP outer surface 504, a vacuum port 505, and a plurality of spacers, a sample of which is indicated as spacer 506. FIG. 6 illustrates a horizontal cross-sectional view of the VIP 408 of FIG. 5. FIG. 7 illustrates an enlarged view of a portion 602 of the horizontal cross-sectional view of FIG. 6.

As depicted in FIG. 7, the portion 602 includes a spacer 702 separated from a spacer 704, wherein the VIP inner surface 502, the VIP outer surface 504, the spacer 702, and the spacer 704 surround a vacuum space 706. The VIP inner surface 502 is configured to cover at least a portion of an outer surface of the water tank 404. The VIP outer surface 504 is separated from the VIP inner surface 502 so as to create a vacuum space therein between. In this example, a portion of the vacuum space is indicated as the vacuum space 706.

In certain embodiments, the vacuum space 706 may not be a true "vacuum." However, the vacuum port 505 is used to pump air out of the vacuum space 706 in an amount that is sufficient to decrease the amount of particles in the vacuum space 706 without decreasing the pressure in an amount that is sufficient to cause the VIP inner surface 502 and the VIP outer surface 504 to touch one another. In some instances, the vacuum port 505 may include a one-way valve or the like to maintain the vacuum within the VIP 408 once the vacuum pump is removed. Any suitable valve may be used in conjunction with the vacuum port 505 to remove air from the VIP 408.

The structural integrity of the VIP inner surface 502 and the VIP outer surface 504 will limit the amount of air that can be removed from the vacuum space 706. In this manner, the material composition of the VIP inner surface 502 and the VIP outer surface 504, the thickness of the VIP inner surface 502 and the VIP outer surface 504, the separation of the VIP inner surface 502 from the VIP outer surface 504, and the distance separating the spacer 702 from the spacer 704 are all factors in determining the maximum amount of air that can be removed from the vacuum space 706 without the VIP inner surface 502 and the VIP outer surface 504 deforming so as to touch one another.

In some instances, the thickness of the VIP inner surface 502 is equal to the thickness of the VIP outer surface 504. In some of these instances, the thickness of the VIP inner surface 502 and the thickness of the VIP outer surface 504 is about 0.063 inches. In some instances, the thickness of the VIP inner surface 502 and the thickness of the VIP outer surface 504 may vary between about 0.015 inches to about 3.0 inches.

In some instances, the vacuum space 706 between the VIP inner surface 502 and the VIP outer surface 504 is larger than the thickness of at least one of the thickness of the VIP inner surface 502 and the VIP outer surface 504. In some of these instances, the thickness of the vacuum space 706 is about 0.124 inches. In some instances, the thickness of the vacuum space 706 may vary between about 0.025 inches to about 1.5 inches. In some cases where the thickness of the VIP inner surface 502 and the thickness of the VIP outer surface 504 is 0.063 inches, the total thickness of the VIP inner surface 502, the VIP outer surface 504, and the vacuum space 706 is about 0.25 inches. The total thickness may vary depending on the thickness of each component.

The reason that the contact between the VIP inner surface 502 and the VIP outer surface 504 is to be avoided is because such a contact would permit heat to be transferred across the VIP 408 via conduction from the VIP inner surface 502 to the VIP outer surface 504 at the point of contact. Such heat conduction is to be avoided, wherein, preferably, heat is only transferred through the VIP 408 via radiation.

The plurality of spacers in the VIP 408 provide support that restricts the VIP inner surface 502 and the VIP outer surface 504 from deforming toward one another to the point where they touch. For example, as shown in FIG. 7, the spacer 702 and the spacer 704 maintains the vacuum space 706 by restricting the VIP inner surface 502 and the VIP outer surface 504 from deforming toward one another to the point where they touch. The maximum low pressure, i.e., the maximum "vacuum," that can be supported within the vacuum space 706 is dependent upon the size, shape, and material of the VIP inner surface 502, the VIP outer surface 504, and the plurality of spacers.

In some embodiments, the VIP inner surface 502, the VIP outer surface 504, and the plurality of spacers are all the same material. Examples of materials for the VIP inner surface 502, the VIP outer surface 504, and the plurality of spacers include metals, alloys, plastics, ceramic, or combination thereof. The plurality of spacers may be any suitable size, shape, or configuration.

In some embodiments, at least one of the VIP inner surface 502, the VIP outer surface 504, and the plurality of spacers are formed of one material, whereas the other of the VIP inner surface 502, the VIP outer surface 504 and the plurality of spacers are of another material. In some instances, the VIP inner surface 502 and the VIP outer surface 504 are formed of a metal, such as steel, whereas the plurality of spacers are formed of a non-metal such as a plastic or ceramic.

While each of the plurality of spacers provides support to separate the VIP inner surface 502 from the VIP outer surface 504, each of the plurality of spacers additionally provides a vector for thermal conduction. If the plurality of spacers are plastic or another low-conductivity material, as opposed to a conductive metal, they would provide less thermal conduction. However, if the plurality of spacers are plastic, as opposed to certain metals, they may provide less support to separate the VIP inner surface 502 from the VIP outer surface 504. Accordingly, the material, the thickness, and the separation between each of the plurality of spacers may be modified to minimize overall heat transfer (or: standby heat loss) of a particular VIP.

As shown in FIG. 7, the VIP 408 may be made of steel and include a thickness of about 0.25 inches, whereas each of the VIP outer surface 504 and the VIP inner surface 502 has a thickness of about 0.063 inches. As such, the vacuum space 706 has a thickness of about 0.124 inches. In some instances, the VIP 408 thickness may vary between about 0.1 inches to about 1.0 inches, and the VIP outer surface 504 and the VIP inner surface 502 thickness may vary between about 0.015 inches to about 0.5 inches. The vacuum space 706 may have an arclength, the distance from the spacer 702 to the spacer 704, of about 6.0 inches. The arclength may vary depending on the size and shape of the various components. Further each of spacer 702 and spacer 704 has a width of about 0.75 inches. In some instances, the width of the spacer 702 and the spacer 704 may vary between about 0.25 inches to about 3.0 inches. The VIP 408 may be any suitable size, shape, or configuration, including the individual components thereof.

In one example, at least one VIP was tested to determine the efficiency gains. In particular, the test included a water tank having a tank diameter of about 18 inches, a tank height of about 25 inches, an insulation corresponding to 410 having a thickness of about 0.875 inches, an insulation thermal conductivity being about 0.0011 Btu/in·F·Hr, a VIP surface emissivity of about 0.3, a temperature of water in the water tank of about 125° F., and an ambient temperature of about 75° F., the heat loss without a VIP in accordance with aspects of the present disclosure was about 83 Btu/hr, whereas the heat loss with a VIP in accordance with aspects of the present disclosure was about 56 Btu/hr. That is a 33% decrease in the rate of heat loss.

In some embodiments, the plurality of spacers are a plurality of longitudinal ribs, for example as shown in FIG. 5. For example, the VIP inner surface 502 and the VIP outer surface 504 may have a longitudinal length as shown by the double arrow 510. In some instances, the longitudinal length may extend the entire length of the water heater for which it would cover. In some examples, the longitudinal length may be 24 inches. In some instances, the longitudinal length vary between about 12 inches to about 72 inches. The plurality of longitudinal ribs have a shorter length as shown by the double arrow 512. In some instances, the length of the longitudinal ribs may be in a range of 1-3 inches shorter than the longitudinal length as shown by double arrow 510. In some instances, the longitudinal ribs may be substantially the same length as the longitudinal length, or slightly smaller (e.g., 0.025-1.0 inches). In some examples, each of the plurality of longitudinal ribs have a rib height of 22 inches, a rib width of 0.5 inches and a rib thickness of 0.125 inches. The longitudinal ribs may be any suitable size, shape or configuration.

All dimensions described herein are exemplary. Any of the components may be any suitable size, shape, or configuration. For example, the lengths, widths, thicknesses, and materials may all vary depending on the application.

By having the longitudinal ribs have a shorter length than the VIP inner surface 502 and the VIP outer surface 504, an airflow space may be formed above each rib and an airflow space below each rib. For example, an airflow space 514 is above the longitudinal rib 506, and an airflow space 516 is below the longitudinal rib 506. The airflow spaces above and below each longitudinal rib enables a single vacuum port to be used when suctioning air from the VIP 408 during manufacture.

In some instances, the plurality of spacers are a plurality of latitudinal circumferential ribs. In other instances, the plurality of spacers are a plurality of protrusions. The plurality of spacers may be any suitable size, shape, or combination thereof.

The VIP 408 discussed with reference to FIGS. 4-7 reduces the rate of heat dissipation radially from a water heater. However, the VIP 408 only covers the circumference of the tank of a water heater. To further reduce the rate of heat dissipation from a water heater, in accordance with one or more embodiments of the present disclosure, a top VIP may be incorporated to cover the top of a tank of a water heater. The top cover may be a separate VIP or may be unitary with other VIP panels disposed about the side and/or bottom of the tank of the water heater.

Figure 8:
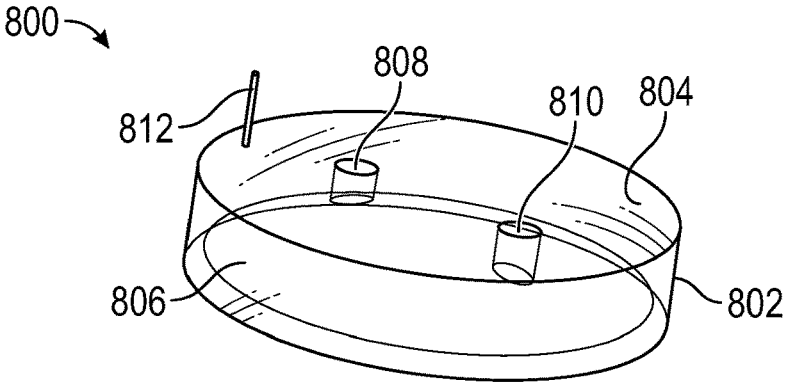
FIG. 8 illustrates an oblique view of a top VIP in accordance with one or more embodiments of the present disclosure.
Figure 9:
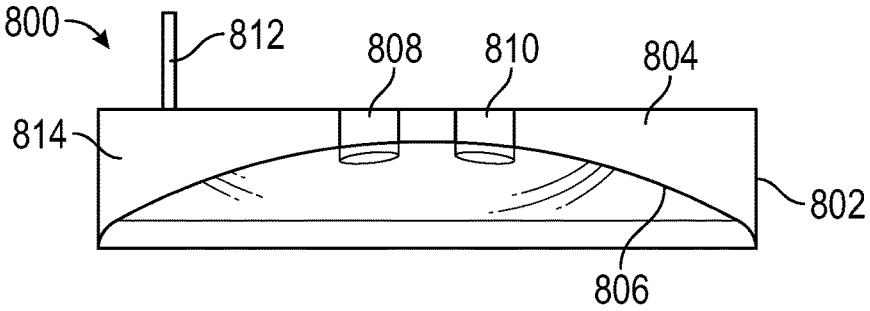
FIG. 9 illustrates a side view of the top VIP of FIG. 8 in accordance with one or more embodiments of the present disclosure.

FIG. 8 illustrates an oblique view of a top VIP 800 in accordance with one or more embodiments of the present disclosure. FIG. 9 illustrates a side view of the top VIP 800 of FIG. 8. The top VIP 800 includes a circumferential side wall 802, a VIP outer top surface 804, a VIP inner top surface 806, a passthrough 808, a passthrough 810, and a vacuum port 812.

The passthrough 808 enables the cold water input line 304 as shown in FIG. 3 to pass through the top VIP 800 and to connect to the top of the water tank, whereas the passthrough 810 enables the hot water output line 306 as shown in FIG. 3 to pass through the top VIP 800 and to connect to the top of the water tank. The vacuum port 812 is used to pump air out of the vacuum space 814 and may include a one-way valve or the like in order to maintain the vacuum within the vacuum space 814 once the vacuum pump is removed.

In certain embodiments, the VIP outer top surface 804 is separated from the VIP inner top surface 806 by a top vacuum space 814. The VIP inner top surface 806 is shaped, in this case in a dome-like shape, so as to cover a top portion of the water tank. The VIP inner top surface 806 may be any suitable size, shape, or configuration. In some instances, each of the circumferential side wall 802, the passthrough 808, and passthrough 810 may act as a spacer that is in contact with both the VIP outer top surface 804 and the VIP inner top surface 806, which may maintain a separation of the VIP outer top surface 804 from the VIP inner top surface 804 to create the top vacuum space 814.

Similar to the vacuum space 706 discussed with reference to FIG. 7, the top vacuum space 814 may be a true or partial vacuum. For example, in some instances, air is pumped out of the top vacuum space 814 in an amount that is sufficient to decrease the amount of particles in the top vacuum space 814 without decreasing the pressure in an amount that is sufficient to cause the VIP inner top surface 806 and the VIP outer top surface 806 to touch one another. In particular, the structural integrity of the VIP inner top surface 806 and the VIP outer top surface 804 will limit the amount of air that can be removed from the top vacuum space 814. In this manner, the material composition of the VIP inner top surface 806 and the VIP outer top surface 804, the thickness of the VIP inner top surface 806 and the VIP outer top surface 804, and the separation of the VIP inner top surface 806 from the VIP outer top surface 804 are all factors in determining the maximum amount of air that can be removed from the vacuum space 814 without the VIP inner top surface 806 and the VIP outer top surface 804 deforming so as to touch one another.

The reason that the contact between the VIP inner top surface 806 and the VIP outer top surface 804 is to be avoided is because such a contact would permit heat to be transferred across the top VIP 800 via conduction from the VIP inner top surface 806 to the VIP outer top surface 804 at the point of contact. Such heat conduction is to be avoided so that heat is preferably only transferred through the top VIP 800 via radiation.

The circumferential side wall 802, the passthrough 808, and the passthrough 810 may provide support that restricts the VIP inner top surface 806 and the VIP outer top surface 804 from deforming toward one another to the point where they touch. The maximum low pressure, i.e., the maximum "vacuum," that can be supported within the vacuum space 814 is dependent upon the size, shape, and material of the circumferential side wall 802, the VIP outer top surface 804, the VIP inner top surface 806, the passthrough 808, and the passthrough 810. In some instances, internal support structures, such as columns, may be added to the top VIP 800 so as to provide support between the VIP outer top surface 804 and the VIP inner top surface 806. Such internal support structures may further reduce the chance of the top VIP 800 collapsing due to vacuum.

In some embodiments, the circumferential side wall 802, the VIP outer top surface 804, the VIP inner top surface 806, the passthrough 808, and the passthrough 810 are all the same material. Examples of materials for the circumferential side wall 802, the VIP outer top surface 804, the VIP inner top surface 806, the passthrough 808, and the passthrough 810 include metals, plastics, ceramic, or combinations thereof. Any suitable material or combinations of materials may be used herein.

In some embodiments, at least one of the circumferential side wall 802, the VIP outer top surface 804, the VIP inner top surface 806, the passthrough 808, and the passthrough 810 are formed of one material, whereas the other of the circumferential side wall 802, the VIP outer top surface 804, the VIP inner top surface 806, the passthrough 808, and the passthrough 810 are of another material. In some instances, the VIP outer top surface 804 and the VIP inner top surface 806 may be a metal, such as steel, whereas the circumferential side wall 802, the passthrough 808, and the passthrough 810 may be a non-metal, such as plastic.

The top VIP 800 discussed with reference to FIGS. 7-9 may reduce the rate of heat dissipation from the top of a water heater. However, the VIP 408 only covers the top of the tank of a water heater. To further reduce the rate of heat dissipation from a water heater, in accordance with one or more embodiments of the present disclosure the VIP 408 may be used in conjunction with the top VIP 800 to cover the top and circumference of a tank of a water heater.

Figure 10:
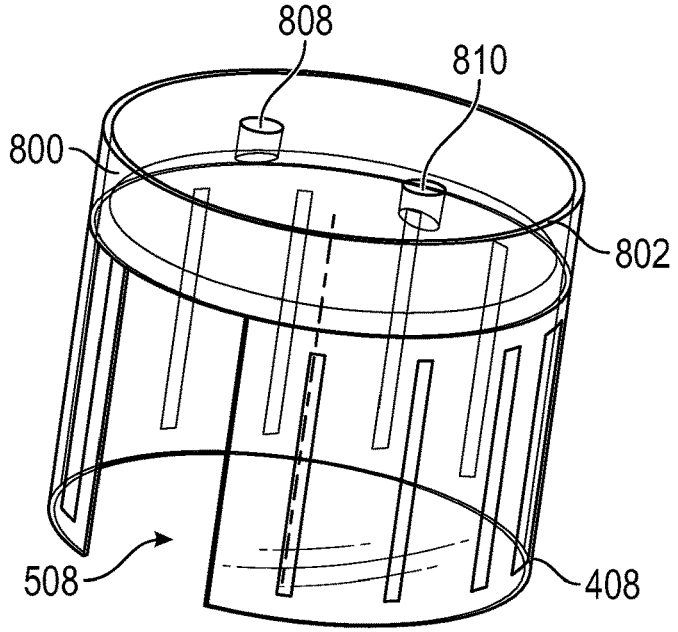
FIG. 10 illustrates a combination of the VIP of FIG. 5 and the top VIP of FIG. 8 in accordance with one or more embodiments of the present disclosure.
Figure 11:
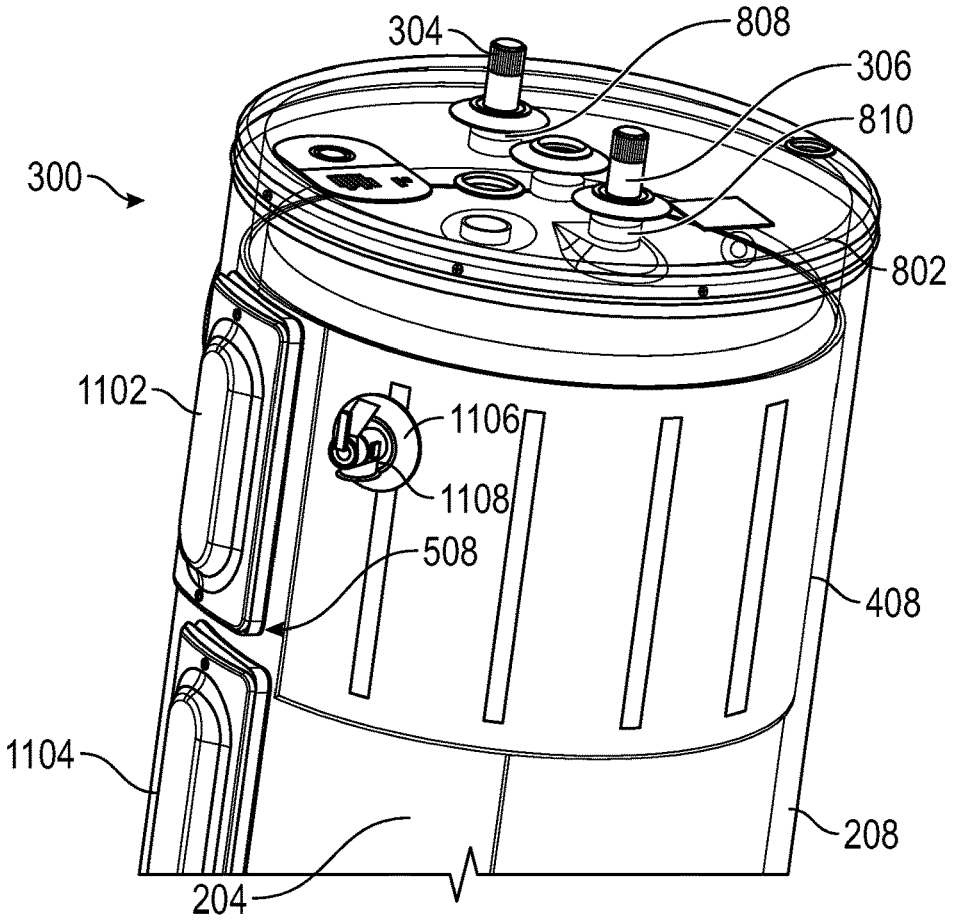
FIG. 11 illustrates an oblique view of a portion of the water heater of FIG. 3 in accordance with one or more embodiments of the present disclosure.

FIG. 10 illustrates a combination of the VIP 408 of FIG. 5 and the top VIP 800 of FIG. 8 in accordance with one or more embodiments of the present disclosure. As shown in FIG. 10, the top VIP 800 is disposed on the VIP 408. FIG. 11 illustrates an oblique view of a portion of the water heater 300 of FIG. 3. As shown in FIG. 11, the top VIP 800 is disposed on top of the tank 204 of the water heater 300, whereas the VIP 408 covers a portion of the side of the tank 204 of the water heater 300.

The space 508 in the VIP 408 enables access to heating source access panels 1102 and 1104. The passthrough 808 enables the cold water input line 304 to pass through the top VIP 800 and to connect to the top of the water tank 204, whereas the passthrough 810 enables the hot water output line 306 to pass through the top of VIP 800 and to connect to the top of the water tank 204. Further additional passthroughs or windows may be disposed in either of the VIP 408 or the top VIP 800, an example of which is indicated as a passthrough 1106 in the VIP 408 to enable a hot water tap 1108 to pass through the VIP 408 to the side of the water tank 204.

In some embodiments, the VIP 408 and the top VIP 800 are a unitary device. That is, in some instances, a single VIP may encompass the entire water tank. The single VIP may include one or more openings or passthroughs for various components.

In some embodiments, the top VIP 800 is configured to be removably placed on top of the VIP 408. In some instances, the top VIP 800 is configured to be attached to the top of the VIP 408. For example, in cases wherein at least one of the circumferential side wall 802 or the VIP inner top surface 806 of the top VIP 800 is metal, and the VIP outer surface 504 of the VIP 408 is metal, the top VIP 800 may be welded to the VIP 408. In another example, in cases wherein the circumferential side wall 802 and the VIP inner top surface 806 of the top VIP 800 is plastic, and the VIP outer surface 504 of the VIP 408 is plastic, the top VIP 800 may be adhered to the VIP 408. In some embodiments, the top VIP 800 is configured to be detachably fastened to the top of the VIP using screws, clamps, etc.

In the embodiment illustrated in FIG. 11, the VIP 408 does not extend all the way down to the bottom of the water tank 204. As depicted in FIG. 11, the VIP 408 only covers the top portion of the water tank 204, wherein the hottest water would reside as hot water rises in the water tank. In such a case, the VIP 408 would be effective in reducing the rate of heat dissipation in this portion of the water tank 204. However, it should be noted that in accordance with one or more embodiments of the present disclosure, the VIP 408 may extend to the bottom of the water tank 204, around the entire water tank 204, or any length there between.

Figure 12:
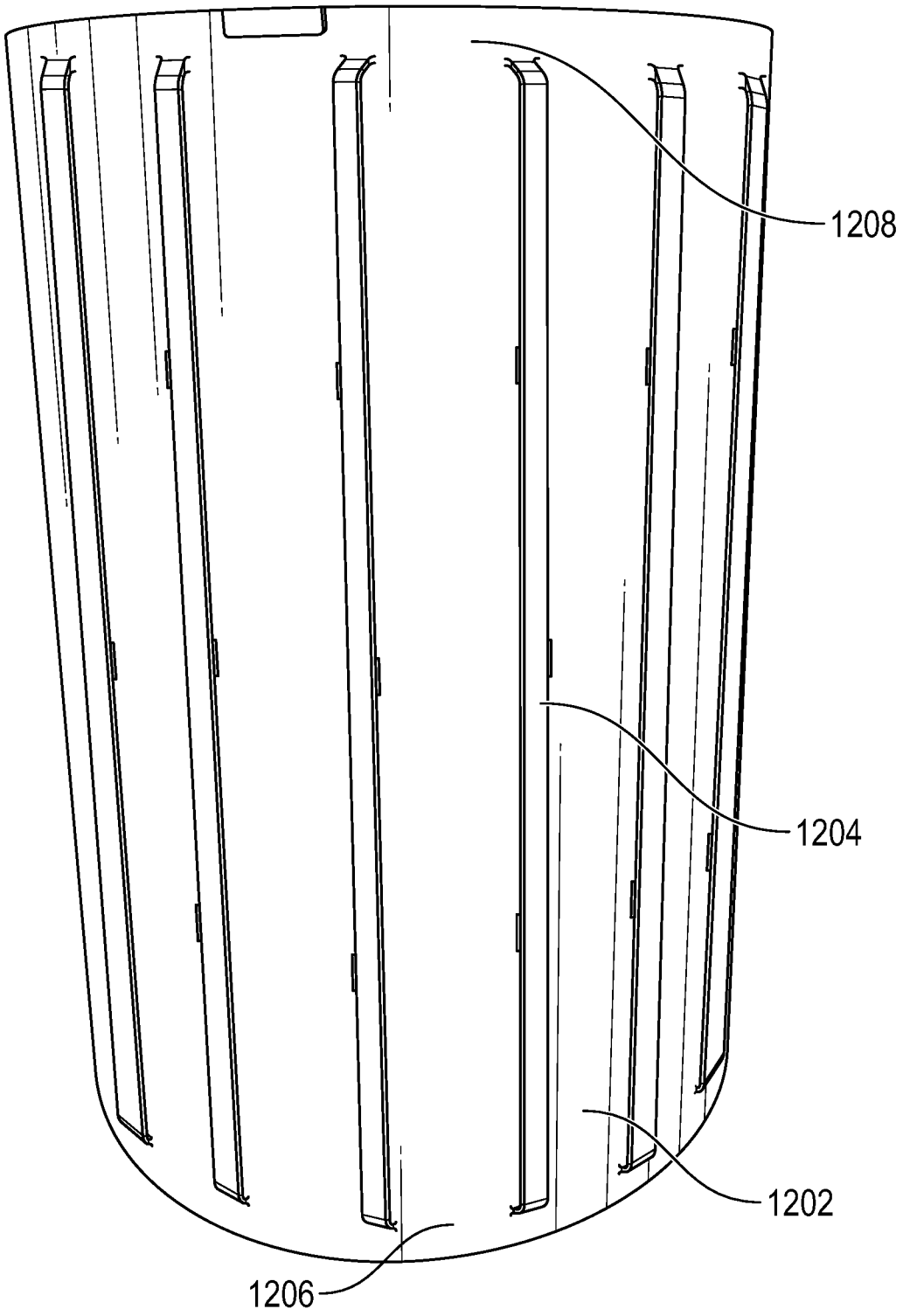
FIG. 12 illustrates an inner shell with a plurality of spacers thereon in accordance with one or more embodiments of the present disclosure.

A working embodiment of a VIP will now be described in detail with reference to FIGS. 12 and 13. FIG. 12 illustrates an inner shell 1202 with a plurality of spacers thereon in accordance with one or more embodiments of the present disclosure. In particular, the inner shell 1202 is made of steel and has a plurality of steel spacers welded thereon, an example of which is indicated as spacer 1204. As mentioned above with reference to FIG. 5, the plurality of spacers form longitudinally disposed ribs on the inner shell 1202, wherein each spacer does not extend the entire height of the inner shell 1202. For example, as shown with the spacer 1204 has a length such that a space 1206 is disposed below the spacer 1204 and a space 1208 is disposed above the spacer 1204. These spaces above and below each spacer enable air flow from between the spacers when air is suctioned out to create a vacuum space. Eventually a steel outer shell is welded to the inner shell 1202 to create a VIP in accordance with one or more embodiments of the present disclosure.

Figure 13:
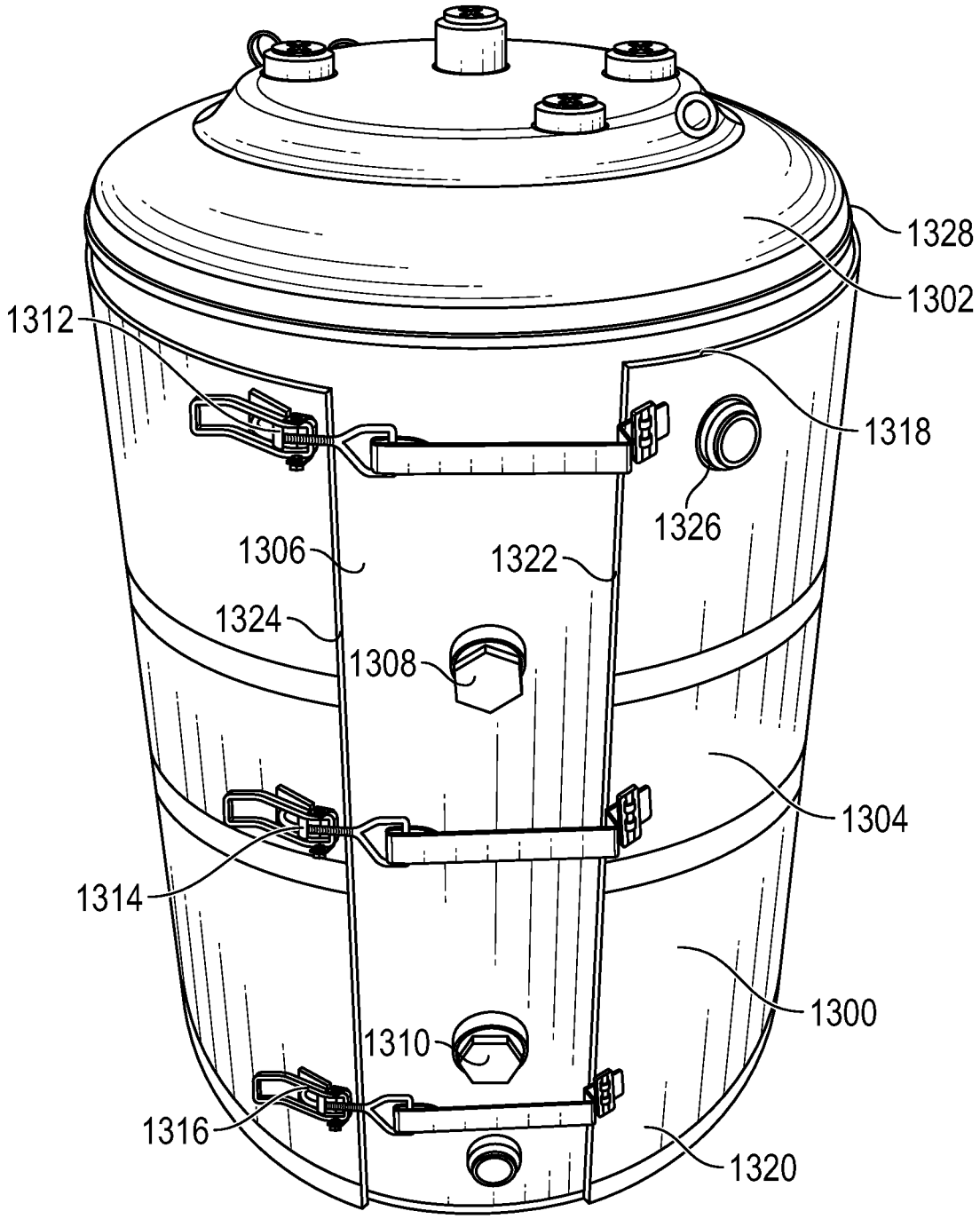
FIG. 13 illustrates a completed VIP in accordance with one or more embodiment of the present disclosure.

FIG. 13 illustrates a completed VIP 1300 in accordance with one or more embodiment of the present disclosure. As shown in the figure, the VIP 1300 surrounds a water tank 1302. The VIP 1300 includes a steel outer shell 1304 that is welded to the inner shell 1202 to cover the plurality of spacers. The VIP 1300 is shaped to have an opening 1306 to provide access to heating source ports 1308 and 1310. The VIP 1300 may be tightly affixed to the water tank 1302 via tightening bands 1312, 1314, and 1316, which may include one or more clamps, fasteners, and/or turnbuckles.

During fabrication, the steel outer shell 1304 is welded to the steel inner shell 1202 on a top welding bead 1318, a lower welding bead 1320, a welding bead 1322 on one side of the opening 1306, a welding bead 1324 on the other side of the opening 1306, and a welding bead for any passthroughs, a sample of which is indicated as a welding bead 1326 for a hot water tap passthrough. A vacuum port 1328 is included to pump air out of the VIP 1300 and may include a one-way valve or the like in order to maintain the vacuum within the vacuum space 814 once the vacuum pump is removed.

As discussed above, some water heater systems have an increased rate of heat transfer as a result of a combination of conduction and convection. In accordance with aspect of one or more embodiments of the present disclosure, a VIP is used to surround at least a portion of the water tank, wherein the VIP reduces the rate thermal transfer by replacing thermal conduction with thermal radiation.

It should be apparent that the foregoing relates only to certain embodiments of the present disclosure and that numerous changes and modifications may be made herein by one of ordinary skill in the art without departing from the general spirit and scope of the disclosure.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may" unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. A vacuum insulation panel for use with a storage vessel having a storage vessel outer surface, the vacuum insulation panel comprising:

a vacuum insulation panel inner surface configured to cover a portion of the storage vessel outer surface;

a vacuum insulation panel outer surface separated from the vacuum insulation panel inner surface by a vacuum space; and a spacer disposed within the vacuum space and in contact with the vacuum insulation panel inner surface and the vacuum insulation panel outer surface for maintaining a separation of the vacuum insulation panel inner surface and the vacuum insulation panel outer surface, wherein the vacuum insulation panel inner surface and the vacuum insulation panel outer surface comprise a first material, wherein the spacer comprises a second material, wherein the first material is different from the second material, wherein the first material comprises a metal, and wherein the second material comprises a non-metal.

2. The vacuum insulation panel of claim 1, wherein the vacuum insulation panel inner surface, the vacuum insulation panel outer surface, and the spacer comprise the same material.

3. The vacuum insulation panel of claim 1, wherein the storage vessel comprises a water heater tank.

4. The vacuum insulation panel of claim 1, further comprising a second spacer disposed within the vacuum space in contact with the vacuum insulation panel inner surface and the vacuum insulation panel outer surface for maintaining a separation of the vacuum insulation panel inner surface and the vacuum insulation panel outer surface.

5. The vacuum insulation panel of claim 4, wherein the spacer and the second spacer are ribs that are separated from one another and are parallel to one another.

6. The vacuum insulation panel of claim 1, further comprising:

a vacuum insulation panel inner top surface configured to cover to a top portion of the storage vessel outer surface; and a vacuum insulation panel outer top surface separated from the vacuum insulation panel inner top surface by a top vacuum space; and a top spacer disposed within the top vacuum space and in contact with the vacuum insulation panel inner top surface and the vacuum insulation panel outer top surface for maintaining a separation of the vacuum insulation panel inner top surface and the vacuum insulation panel outer top surface.

7. The vacuum insulation panel of claim 6, wherein the vacuum insulation panel inner surface, the vacuum insulation panel outer surface, the spacer, the vacuum insulation panel inner top surface, the vacuum insulation panel outer top surface, and the top spacer are a unitary structure.

8. The vacuum insulation panel of claim 6, wherein the vacuum insulation panel inner top surface, the vacuum insulation panel outer top surface, and the top spacer are removably attached to the vacuum insulation panel inner surface, the vacuum insulation panel outer surface, and the spacer.

9. A water heater comprising:

a storage vessel; and a vacuum insulation panel comprising:

a vacuum insulation panel inner surface configured to cover a portion of the storage vessel outer surface, a vacuum insulation panel outer surface separated from the vacuum insulation panel inner surface by a vacuum space, and a spacer disposed within the vacuum space and in contact with the vacuum insulation panel inner surface and the vacuum insulation panel outer surface for maintaining a separation of the vacuum insulation panel inner surface and the vacuum insulation panel outer surface, wherein the vacuum insulation panel inner surface and the vacuum insulation panel outer surface comprise a first material wherein the spacer comprises a second material, wherein the first material is different from the second material, wherein the first material comprises a metal, and wherein the second material comprises a non-metal.

10. The water heater of claim 9, wherein the vacuum insulation panel inner surface, the vacuum insulation panel outer surface, and the spacer comprise the same material.

11. The water heater of claim 9, wherein the storage vessel comprises a water heater tank.

12. The water heater of claim 9, further comprising a second spacer disposed within the vacuum space in contact with the vacuum insulation panel inner surface and the vacuum insulation panel outer surface for maintaining a separation of the vacuum insulation panel inner surface and the vacuum insulation panel outer surface.

13. The water heater of claim 12, wherein the spacer and the second spacer are ribs that are separated from one another and are parallel to one another.

14. The water heater of claim 9, further comprising:

a vacuum insulation panel inner top surface configured to cover to a top portion of the storage vessel outer surface; and a vacuum insulation panel outer top surface separated from the vacuum insulation panel inner top surface by a top vacuum space; and a top spacer disposed within the top vacuum space and in contact with the vacuum insulation panel inner top surface and the vacuum insulation panel outer top surface for maintaining a separation of the vacuum insulation panel inner top surface and the vacuum insulation panel outer top surface.

15. The water heater of claim 14, wherein the vacuum insulation panel inner surface, the vacuum insulation panel outer surface, the spacer, the vacuum insulation panel inner top surface, the vacuum insulation panel outer top surface, and the top spacer are a unitary structure.

16. A vacuum insulation panel for use with a storage vessel having a storage vessel outer surface, the vacuum insulation panel comprising:

a vacuum insulation panel inner surface configured to cover a portion of the storage vessel outer surface;

a vacuum insulation panel outer surface separated from the vacuum insulation panel inner surface by a vacuum space;

a spacer disposed within the vacuum space and in contact with the vacuum insulation panel inner surface and the vacuum insulation panel outer surface for maintaining a separation of the vacuum insulation panel inner surface and the vacuum insulation panel outer surface;

a vacuum insulation panel inner top surface configured to cover to a top portion of the storage vessel outer surface;

a vacuum insulation panel outer top surface separated from the vacuum insulation panel inner top surface by a top vacuum space; and a top spacer disposed within the top vacuum space and in contact with the vacuum insulation panel inner top surface and the vacuum insulation panel outer top surface for maintaining a separation of the vacuum insulation panel inner top surface and the vacuum insulation panel outer top surface.

17. The vacuum insulation panel of claim 16, wherein the vacuum insulation panel inner surface, the vacuum insulation panel outer surface, the spacer, the vacuum insulation panel inner top surface, the vacuum insulation panel outer top surface, and the top spacer are a unitary structure.

18. The vacuum insulation panel of claim 16, wherein the vacuum insulation panel inner top surface, the vacuum insulation panel outer top surface, and the top spacer are removably attached to the vacuum insulation panel inner surface, the vacuum insulation panel outer surface, and the spacer.

* * * * *